US008362991B2

(12) United States Patent
Lee et al.

(10) Patent No.: US 8,362,991 B2
(45) Date of Patent: Jan. 29, 2013

(54) APPARATUS AND METHOD FOR DRIVING LIQUID CRYSTAL DISPLAY DEVICE

(75) Inventors: Kyoung-Hun Lee, Gyeongbuk (KR); Tae-Koon Kim, Daejeon (KR)

(73) Assignee: LG Display Co., Ltd., Seoul (KR)

( * ) Notice: Subject to any disclaimer, the term of this patent is extended or adjusted under 35 U.S.C. 154(b) by 598 days.

(21) Appl. No.: 12/642,172

(22) Filed: Dec. 18, 2009

(65) Prior Publication Data

US 2010/0156928 A1 Jun. 24, 2010

(30) Foreign Application Priority Data

Dec. 24, 2008 (KR) ..... 10-2008-0133273

(51) Int. Cl.
*G09G 3/30* (2006.01)

(52) U.S. Cl. ..... 345/87; 345/204; 345/89

(58) Field of Classification Search ..... None
See application file for complete search history.

(56) References Cited

U.S. PATENT DOCUMENTS

| | | | | |
|---|---|---|---|---|
| 7,193,599 | B2 * | 3/2007 | Kim et al. | 345/98 |
| 2002/0105506 | A1 * | 8/2002 | Hiyama et al. | 345/204 |
| 2003/0169247 | A1 * | 9/2003 | Kawabe et al. | 345/204 |

* cited by examiner

*Primary Examiner* — Joseph Haley
(74) *Attorney, Agent, or Firm* — Birch, Stewart, Kolasch & Birch, LLP

(57) ABSTRACT

Discussed are an apparatus and method for driving a liquid crystal display device, which can improve picture quality by changing a driving mode displaying images according to setting information from a user or to an image characteristic. An apparatus for driving a liquid crystal display device includes a liquid crystal panel including a plurality of pixel regions to display images, and a liquid crystal panel driving controller for performing either a black data addressing method for time-division driving the liquid crystal panel or a gate pulse modulation method for converting a level of a gate-on voltage supplied to the liquid crystal panel, according to setting information from a user or a moving image or still image characteristic of a currently displayed image.

7 Claims, 5 Drawing Sheets

APPARATUS AND METHOD FOR DRIVING LIQUID CRYSTAL DISPLAY DEVICE

This application claims the benefit of Korean Patent Application No. 10-2008-0133273, filed on Dec. 24, 2008, which is hereby incorporated by reference as if fully set forth herein.

BACKGROUND OF THE INVENTION

1. Field of the Invention

The present invention relates to a liquid crystal display device, and more particularly, to an apparatus and method for driving a liquid crystal display device, which can improve picture quality by changing a driving mode displaying images according to setting information from a user or to an image characteristic.

2. Discussion of the Related Art

A liquid crystal display device displays images using electro-optical characteristics of a liquid crystal. The liquid crystal shows anisotropic properties having different refractive indexes and different dielectric constants according to long-axis and short-axis directions of molecules, and molecule arrangement and optical properties thereof can be easily controlled. The liquid crystal display device using the liquid crystal adjusts light transmittance by varying the orientation of liquid crystal molecules according to the intensity of an electric field, thereby displaying images. To this end, the liquid crystal display device includes a liquid crystal panel including a plurality of pixels arranged in a matrix and includes a driving circuit for driving the liquid crystal panel.

The liquid crystal display device has a disadvantage of a slow response time of the liquid crystal due to the properties of unique viscosity and elasticity of the liquid crystal. The response time of the liquid crystal varies with physical properties of liquid crystal material and a cell gap, and a rising time and a falling time are generally 20 to 80 ms and 20 to 30 ms, respectively.

The response time of the liquid crystal is longer than one frame period (e.g., 16.67 ms in NTSC) of a moving display image. Accordingly, one frame proceeds to a next frame before a voltage charged to a liquid crystal cell reaches a desired voltage. Then, a display image of each frame displayed on the liquid crystal panel affects a display image of a next frame and a motion blurring phenomenon occurs that blurs a moving image displayed on the liquid crystal panel due to perception characteristics of a viewer. In the liquid crystal display device according to a related art, a contrast ratio is deteriorated due to such a motion blurring phenomenon generated on a display image and image sticking occurs, thereby lowering picture quality.

To overcome such problems, a method for increasing a driving voltage, for example, a pixel voltage or a gate voltage, applied to the liquid crystal cell has been conventionally used. However, when moving images are displayed, colors may be shifted or blurred.

SUMMARY OF THE INVENTION

Accordingly, the present invention is directed to a an apparatus and method for driving a liquid crystal display device that substantially obviate one or more problems due to limitations and disadvantages of the related art.

An object of the present invention is to provide a an apparatus and method for driving a liquid crystal display device, which can improve picture quality by changing a driving mode displaying images according to setting information from a user or to an image characteristic.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for driving a liquid crystal display device includes a liquid crystal panel including a plurality of pixel regions to display images, and a liquid crystal panel driving controller for performing either a black data addressing method for time-division driving the liquid crystal panel or a gate pulse modulation method for converting a level of a gate-on voltage supplied to the liquid crystal panel, according to setting information from a user or a moving image or still image characteristic of a currently displayed image.

The liquid crystal panel driving controller may include a data driver for driving data lines of the liquid crystal panel, a gate driver for driving gate lines of the liquid crystal panel, a setting unit for generating a mode conversion signal corresponding to the moving image or still image characteristic by analyzing the setting information or externally input image data, a timing controller for supplying the image data, or conversion image data including black data to the data driver in response to the mode conversion signal and generating a data control signal for enabling time-division driving according to the mode conversion signal to control the data driver, and a driving voltage setting unit for converting a supply characteristic of at least one voltage among a plurality of gate driving voltages supplied to the gate driver in response to the mode conversion signal.

The setting unit may include a memory for storing image data of a previous frame, a data comparator for comparing the image data of the previous frame with image data of a current frame and generating synchronous detection signals according to a comparison result, a mode conversion signal generator for generating the mode conversion signal according to the setting information, or counting the synchronous detection signals, storing the number of counts in units of a frame and generating the mode conversion signal indicating the moving image or still image characteristic according to the stored number of counts of units of a frame, and a frequency modulator for converting frequencies of externally input synchronous signals according to the mode conversion signal and supplying the frequency-converted signals to the timing controller.

The mode conversion signal generator may generate the mode conversion signal indicating the moving image characteristic or still image characteristic depending on whether the stored number of counts in units of a frame is above or below a number set by a user during a frame set by a user.

The driving voltage setting unit may include a driving voltage generator for generating a common voltage, a gate high voltage, and a gate low voltage using an externally input positive-polarity voltage and negative-polarity voltage, and a gate voltage converter for supplying the gate high voltage to the gate driver in response to the mode conversion signal of the moving image characteristic and boosting a level of the gate high voltage in response to the mode conversion signal of the still image characteristic to supply the boosted voltage to the gate driver.

In another aspect of the present invention, a method for driving a liquid crystal display device includes determining whether a currently displayed image is a moving image or a still image according to setting information preset by a user, analyzing whether a currently displayed image is a moving image or a still image by analyzing externally input image data, generating a mode conversion signal corresponding to a moving image or still image characteristic according to the setting information or the analyzed result, and performing either a black data addressing method for time-division driving a liquid crystal panel or a gate pulse modulation method for converting a supply characteristic of a gate-on voltage supplied to the liquid crystal panel, according to the mode conversion signal.

The performing of either the black data addressing method or the gate pulse modulation method may include generating the image data, or conversion image data including black data in response to the mode conversion signal and supplying the generated data to a data driver, generating a data control signal for enabling time-division driving according to the mode conversion signal to control the data driver, converting a level of at least one voltage among a plurality of gate driving voltages supplied to a gate driver in response to the mode conversion signal, and converting a frequency of an externally input synchronous signal according to the mode conversion signal and supplying the frequency-converted signal to a timing controller.

The generating of the mode conversion signal may include storing image data of a previous frame, comparing the image data of the previous frame with image data of a current frame and generating synchronous detection signals according to the comparison result, and counting the synchronous detection signals, storing the number of counts in units of a frame, and generating the mode conversion signals indicating the moving image or still image characteristic according to the stored number of counts in units of a frame.

The generating of the mode conversion signal may generate the mode conversion signals indicating the moving image or still image characteristic according to whether the stored number of counts in units of a frame is above or below a number set by a user during a frame period set by a user.

The converting of the level of at least one voltage may include generating a gate high voltage and a gate low voltage using an externally input positive-polarity and negative-polarity voltages, supplying the gate high voltage to the gate driver in response to the mode conversion signal indicating the moving image characteristic, and supplying the gate high voltage, a charge characteristic of which is not deteriorated, to the gate driver in response to the mode conversion signal indicating the still image characteristic.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Figure 1:
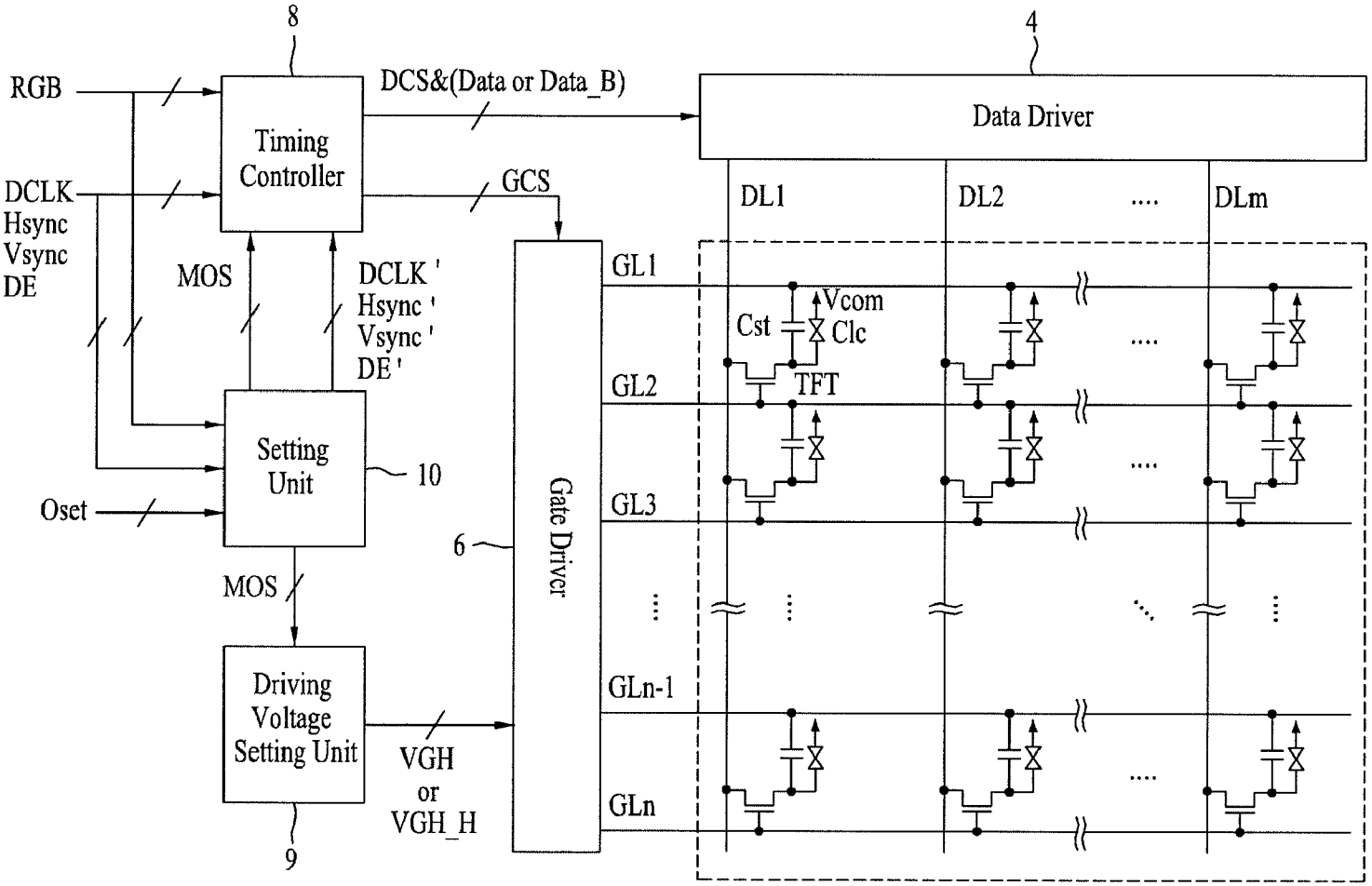
FIG. 1 illustrates the construction of a driving apparatus for a liquid crystal display device according to an exemplary embodiment of the present invention.

FIG. 1 illustrates the construction of a driving apparatus for a liquid crystal display device according to an exemplary embodiment of the present invention.

The liquid crystal display device shown in FIG. 1 includes a liquid crystal panel 2 and a liquid crystal panel driving controller. The liquid crystal panel 2 includes a plurality of pixel regions to display images. The liquid crystal panel driving controller performs either a black data addressing method for driving the liquid crystal panel 2 by time division or a gate pulse modulation method for varying the characteristics of gate-on voltages supplied to the liquid crystal panel, according to setting information Oset from a user or the characteristic of a currently displayed image.

More specifically, the liquid crystal panel driving controller includes a data driver 4, a gate driver 6, a setting unit 10, a timing controller 8, and a driving voltage setting unit 9. The data driver 4 drives data lines DL1 to DLm of the liquid crystal panel 2. The gate driver 6 drives gate lines GL1 to GLn of the liquid crystal panel 2. The setting unit 10 generates a mode conversion signal MOS corresponding to a moving image or still image characteristic by analyzing the setting information Oset from a user or externally input image data RGB, and increases a frequency of each of externally input synchronous signals DCLK, Vsync, Hsync, and DE according to the mode conversion signal MOS corresponding to the moving image characteristic. The timing controller 8 supplies the image data RGB or conversion image data Data_B including black data to the data driver 4 in response to the mode conversion signal MOS and generates a data control signal DCS for enabling time-division driving according to the mode conversion signal MOS to control the data driver 4. The driving voltage setting unit 9 converts a supply characteristic of at least one voltage among a plurality of gate driving voltages supplied to the gate driver 6 in response to the mode conversion signal MOS.

The liquid crystal panel 2 includes thin film transistors (TFTs) formed in pixel regions defined by a plurality of gate lines GL1 to GLn and a plurality of data lines DL1 to DLm and includes liquid crystal capacitors Clc connected to the TFTs. Each liquid crystal capacitor Clc is comprised of a pixel electrode connected to the TFT, and a common electrode facing the pixel electrode with a liquid crystal disposed therebetween. The TFTs supply image signals from the gate lines DL1 to DLm to the pixel electrodes of the liquid crystal capacitors Clc in response to scan pulses from the respective gate lines GL1 to GLn. Each of the liquid crystal capacitors Clc charges a difference voltage between the image signal supplied to the pixel electrode and a common voltage supplied to the common electrode and varies orientation of liquid crystal molecules according to the difference voltage to adjust light transmittance, thereby achieving a gray scale. Storage capacitors Cst are connected in parallel to the liquid crystal capacitors Clc to maintain voltages charged to the liquid crystal capacitors Clc until a next data signal is supplied. The storage capacitor Cst is formed by overlapping the pixel electrode and a previous gate line with an insulating layer disposed therebetween. The storage capacitor Cst may be formed by overlapping the pixel electrode and a storage line with an insulating layer disposed therebetween.

The setting unit 10 generates the mode conversion signal MOS corresponding to the setting information Oset from a user. The setting information Oset refers to information that is input by a user to previously set an image display mode according to a displayed image characteristic. A user may set a signal corresponding to display information of a moving image or a still image according to an image characteristic to be displayed and may set the signal to convert a driving mode according to an input image.

The setting unit 10 may set and output the mode conversion signal MOS corresponding to a moving image or a still image according to the setting information Oset from a user. Alternatively, the setting unit 10 may output the mode conversion signal MOS corresponding to a moving image or a still image so as to be suitable for a characteristic of the input image data RGB according to the setting information Oset from a user. In this case, the setting unit 10 compares and analyzes the image data RGB of a current frame with the image data of a previous frame and determines whether a currently displayed image is a moving image or a still image. The setting unit 10 then generates the mode conversion signal MOS so as to represent a moving image or still image characteristic according to the determined result.

If the currently displayed image is determined as a moving image, that is, if the mode conversion signal MOS so as to represent the moving image is output, the setting unit increases a frequency of each of the externally input synchronous signals DCLK, Vsync, Hsync, and DE and supplies the frequency-increased synchronous signals DCLK', Vsync', Hsync', and DE' to the timing controller 8. In this case, the frequency of each of the synchronous signals DCLK', Vsync', Hsync', and DE' may be twice the frequency of each of the synchronous signals DCLK, Vsync, Hsync, and DE so that the timing controller 8 and the data driver 4 can perform time-division driving.

The timing controller 8 generates the conversion image data Data_B including a black image and supplies the conversion image data Data_B to the data driver 4, so that the respective sub-pixels of the liquid crystal panel 2 display an image signal during a ½ period of one horizontal period and display a black image during the other ½ period. The timing controller 8 includes a memory for storing black image data and the externally input image data RGB and generates the conversion image data Data_B by inserting the black image data into the image data RGB according to at least one of the frequency-modulated synchronous signals DCLK', Vsync', Hsync', and DE'.

The timing controller 8 doubles a frequency of the data control signal DCS, using the frequency-increased synchronous signals DCLK', Vsync', Hsync', and DE'. However, if the mode conversion signal MOS indicating a still image characteristic is supplied, the timing controller 8 arranges the externally input image data RGB, supplies the image data RGB to the data driver 4 without any modification, and generates the data control signal DCS using the synchronous signals DCLK, Vsync, Hsync, and DE, frequencies of which are not modulated. The setting unit 10, the timing controller 8, and the driving voltage setting unit 9 will be described in detail with reference to the attached drawings.

The data driver 4 converts the image data Data arranged from the timing controller 8 into an analog voltage, that is, an image signal, using the data control signal DCS received from the timing controller 8, for example, using a source start pulse (SSP), a source shift clock (SSC), a source output enable (SOE) signal, etc. If the conversion image data Data_B including the black data is input together with the data control signal DCS, frequency of which is doubled, from the timing controller 8, the data driver 4 converts the conversion image data Data_B including the black data into an analog image signal two times faster in response to the frequency-increased data control signal DCS. The frequency-increased data control signal DCS may be the SSP, SSC, SOE signal, etc., frequencies of which are doubled, so as to enable time-division driving. One frequency period is identically maintained due to time-division driving.

More specifically, the data driver 4 latches the image data Data arranged through the timing controller 8 in response to the SSC and supplies an image signal corresponding to one horizontal line to the data lines DL1 to DLm every one horizontal period during which a scan pulse is supplied to the gate lines GL1 to GLn in response to the SOE signal. If the frequency-increased SSC is input, the data driver 4 latches the conversion image data Data_B including the black image data and supplies an image signal including the black data corresponding to one horizontal line to the data lines DL1 to DLm every ½ horizontal period of one horizontal period in response to the SOE signal. At this time, the data driver 4 selects a gamma voltage of positive or negative polarity having a prescribed level according to a gray scale value of the arranged data Data and supplies the selected gamma voltage to the data lines DL1 to DLm as the image signal. For the conversion image data Data_B including the black data, the data driver 4 supplies the image signal to the data lines DL1 to DLm during a ½ period of one horizontal period and supplies the black image signal to the data lines DL1 to DLm during the other ½ horizontal period.

The gate driver 6 sequentially generates a scan pulse in response to a gate control signal GCS from the timing controller 8, for example, in response to a gate start pulse (GSP), a gate shift clock (GSC), a gate output enable (GOE) signal and sequentially supplies the scan pulse to the gate lines GL1 to GLn. In other words, the gate driver 6 sequentially supplies the scan pulse, for example, a gate-on voltage to the gate lines GL1 to GLn by shifting the GSP from the timing controller 8 according to the GSC. When the gate-on voltage is not supplied to the gate lines GL1 to GLn, the gate driver 6 supplies a gate-off voltage. Here, the gate driver 6 controls a pulse width of the scan pulse according to the GOE signal.

A level of the scan pulse supplied to the gate lines GL1 to GLn through the gate driver 6, that is, a level of the gate-on voltage may vary according to a level of gate high signal VGH or VGH_H input from the driving voltage setting unit 9. Specifically, the level of the gate-on voltage that is sequentially output through the gate driver 6 is determined according to a supply characteristic of the gate high signal VGH or VGH_H supplied from the driving voltage setting unit 9. Therefore, if the driving voltage setting unit 9 supplies, to the gate driver 6, the gate high signal of a level generated normally according to the mode conversion signal MOS, that is, the gate high signal VGH, a voltage supply characteristic of which is not changed, the level of the gate-on voltage is output as the gate high signal VGH, a charge characteristic of which is somewhat deteriorated. Meanwhile, if the driving voltage setting unit 9 supplies, to the gate driver 6, the gate high signal VGH, a voltage supply characteristic of which is changed, according to the mode conversion signal MOS, the gate high signal VGH_H of a prescribed level is output so as not to deteriorate a charge characteristic. Although not shown in the drawing, if the driving voltage setting unit 9 boosts a level of the gate high signal VGH up to a preset level according to the mode conversion signal MOS and supplies the boosted gate high signal to the gate driver 6, the level of the gate-on voltage of the same level as the boosted gate high signal is output.

More specifically, the driving voltage setting unit supplies the gate high signal, a voltage supply characteristic of which is not changed, to the gate driver 6 when the mode conversion signal MOS indicating a moving image characteristic is input. If a prescribed time elapses after the gate-on voltage is charged to the gate lines GL1 to GLn, loss of the level of the gate-on voltage may somewhat occur. If the mode conversion signal MOS indicating a still image characteristic is supplied to the driving voltage setting unit 9, the driving voltage setting unit 9 may supply the gate high signal VGH_H, a voltage supply characteristic of which is changed, to the gate driver 6. In this case, the level of the gate-on voltage is maintained until the gate-off voltage is input.

The driving voltage setting unit 9 generates and supplies driving voltages necessary for the timing controller 8, the data driver 4, and the gate driver 6 constituting the liquid crystal display device. For example, the driving voltage setting unit 9 supplies a positive-polarity voltage VDD and a negative-polarity voltage VSS to the timing controller 8. The driving voltage setting unit 9 supplies a common voltage to the liquid crystal panel 2 and supplies the gate high voltage VGH or the level-boosted gate high voltage VGH_H to the gate driver 6 together with a gate low voltage to the gate driver 6. More specifically, when the mode conversion signal MOS indicating a moving image characteristic is input from the setting unit 10, the driving voltage setting unit 9 generates the gate high voltage VGH of a general level and supplies the gate high voltage VGH to the gate driver 6. When the mode conversion signal MOS indicating a still image characteristic is input from the setting unit 10, the driving voltage setting unit 6 generates the gate high voltage VGH_H, a voltage supply characteristic of which is changed, and supplies the gate high voltage VGH_H to the gate driver 6.

As described above, if the setting information Oset from a user is set as a moving image display state or an image characteristic analysis result indicates that a currently displayed image is a moving image, the liquid crystal display device of the present invention performs a black data addressing method for displaying a black image every ½ period of one horizontal period by time-division driving respective sub-pixels. If the currently displayed image is a still image, the black data addressing method is not performed and a gate pulse modulation method for sequentially supplying the gate-on voltage, a voltage supply characteristic of which is changed, to the gate lines GL1 to GLn is performed.

Figure 2:
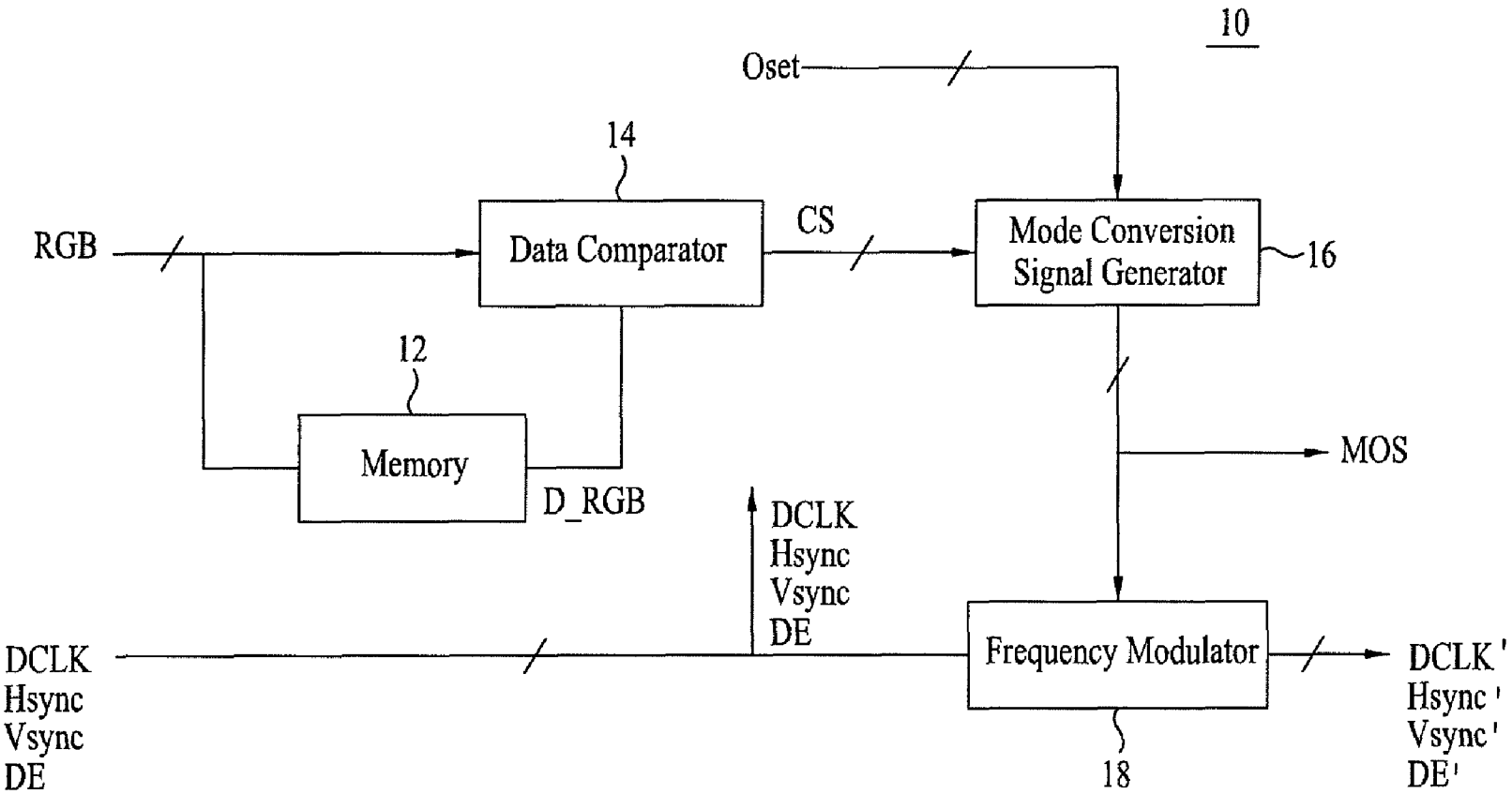
FIG. 2 illustrates the detailed construction of a setting unit shown in FIG. 1.

FIG. 2 illustrates the detailed construction of the setting unit 10 shown in FIG. 1.

The setting unit 10 includes a memory 12 for storing image data D_RGB of a previous frame, a data comparator 14 for comparing the image data D_RGB of a previous frame with image data RGB of a current frame and generating synchronous detection signals CS according to a comparison result, a mode conversion signal generator 16 for generating a mode conversion signal MOS indicating a moving image or still image characteristic according to setting information Oset, or counting the synchronous detection signals CS, storing the number of counts in units of a frame and generating the mode conversion signal MOS indicating a moving image or still image characteristic depending on whether the stored number of counts of the units of a frame is above or below a number set by a user during a frame period set by a user, and a frequency modulator 18 for converting a frequency of each of externally input synchronous signals DCLK, Vsync, Hsync, and DE according the mode conversion signal MOD and supplies the frequency-converted signals to the timing controller 8.

The memory 12 stores the externally input image data RGB in unit of at least one frame and sequentially supplies the stored image data RGB, that is, the image data D_RGB of a previous frame to the data comparator 14.

The data comparator 14 compares, in units of at least one frame, the image data D_RGB of a previous frame that is sequentially input from the memory 12 with the image data RGB of a current frame. More specifically, the data comparator 14 sequentially compares a gray scale value of each sub-pixel or a unit pixel contained in the image data D_RGB of the previous frame with a gray scale value of each sub-pixel or a unit pixel of the currently input image data RGB. If the compared gray scale values are synchronized with each other, the data comparator 14 generates the synchronous detection signals CS, for example, synchronous clocks and supplies the synchronous detection signals CS to the mode conversion signal generator 16.

The mode conversion signal generator 16 counts the synchronous detection signals CS input from the data comparator 14 and stores the number of counts in units of a frame. If the number of counts in units of a frame is above a number set by a user during a frame period set by a user, the mode conversion signal generator 16 generates the mode conversion signal MOS indicating a still image. If the number of counts in units of a frame is below a number set by a user during a frame period set by a user, the mode conversion signal generator 16 generates the mode conversion signal MOS indicating a moving image. The mode conversion signal MOS may be generated as at least one bit value. For example, the mode conversion signal indicating a still image may be generated as "00" and the mode conversion signal indicating a moving image may be generated as "11". The generated mode conversion signal MOS is supplied to the frequency modulator 18, the timing controller 8, and the driving voltage setting unit 9.

The frequency modulator 18 increases a frequency of each of the externally input synchronous signals DCLK, Vsync, Hsync, and DE according to the mode conversion signal MOS and supplies the frequency-increased signals DCLK', Hsync', Vsync' and DE' to the timing controller 8. Specifically, if the mode conversion signal MOS indicating a still image, for example, a signal of "00" is input from the mode conversion signal generator 16, the frequency modulator 18 transitions to a standby mode without performing any operation. If the mode conversion signal MOS indicating a moving image, for example, a signal of "11" is input from the mode conversion signal generator 16, the frequency modulator 18 increases a frequency of each of the input synchronous signals DCLK, Vsync, Hsync, and DE to at least two times and supplies the frequency-increased signals DCLK', Vsync', Hsync', and DE' to the timing controller 8. More specifically, the frequency of each of the synchronous signals DCLK, Vsync, Hsync, and DE input to the frequency modulator 18 may be 60 Hz. Then the frequency modulator 18 increases the frequency of each of the synchronous signals DCLK, Vsync, Hsync, and DE to a frequency of 120 Hz. Accordingly, the pulse width of the synchronous signals DCLK', Vsync', Hsync', and DE' frequency-increased to 120 Hz is reduced to ½ the pulse width of each of the synchronous signals DCLK, Vsync, Hsync, and DE.

Figure 3:
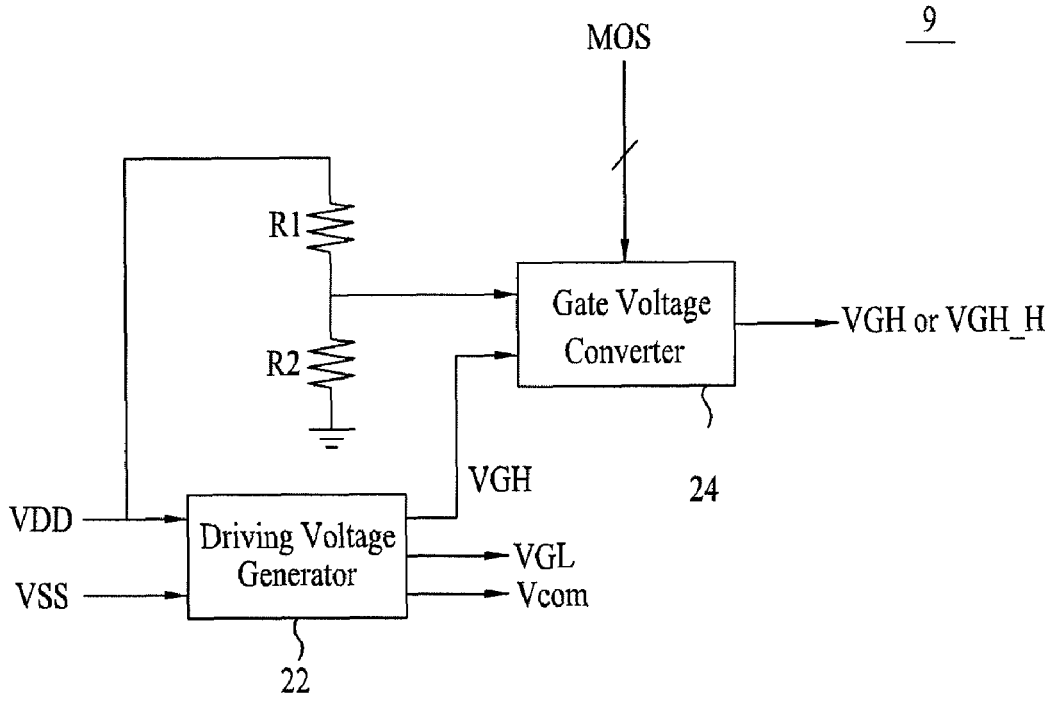
FIG. 3 illustrates the detailed construction of a driving voltage setting unit shown in FIG. 1.

The driving voltage setting unit 9 of FIG. 3 includes a driving voltage generator 22 for generating a common voltage Vcom, a gate high voltage VGH, and a gate low voltage VGL using an externally input positive-polarity voltage VDD and negative-polarity voltage VSS, and a gate voltage converter 24 for supplying the gate high voltage VGH to the gate driver 6 in response to a mode conversion signal MOS of a moving image characteristic and converting a supply characteristic of the gate high voltage VGH in response to the mode conversion signal MOS of a still image characteristic to supply the characteristic-converted gate high voltage VGH_H to the gate driver 6.

The driving voltage generator 22 corrects a level of the positive-polarity driving voltage VDD that is input using at least one power integrated circuit (IC) or direct current (DC)/DC converter, and a voltage level corrector, which are not shown, and generates a plurality of driving voltages suitable for driving the liquid crystal display device, for example, the common voltage Vcom, the gate high voltage VGH, and the gate low voltage VGL. The gate low voltage VGL and the gate high voltage VGH generated through the driving voltage generator 22 are supplied to the gate driver 6 and the common voltage Vcom is supplied to the liquid crystal panel 2. The positive-polarity driving voltage VDD is supplied to the data driver 4 without changing a level thereof.

The gate voltage converter 24 includes at least one of a gate pulse modulation (GPM) IC for performing a GPM operation, a power IC, and a DC/DC converter, and a peripheral circuit of resistors R1 and R2 connected in series/parallel or a capacitor. If the mode conversion signal MOS of the moving image characteristic is input, the gate voltage converter 24 supplies the gate high voltage VGH input from the driving voltage generator 22 to the gate driver 6. If the mode conversion signal MOS of the still image characteristic is input, the gate voltage converter 24 supplies the gate high voltage VGH converting a supply characteristic to the gate driver 6. In this case, the gate voltage converter 24 may boost a level of the gate high voltage VGH to a preset level and may supply the boosted voltage to the gate driver 6. Here, the gate high voltage VGH of 17 volts (V) to 25 V may be supplied to the gate driver 6.

Figure 4:
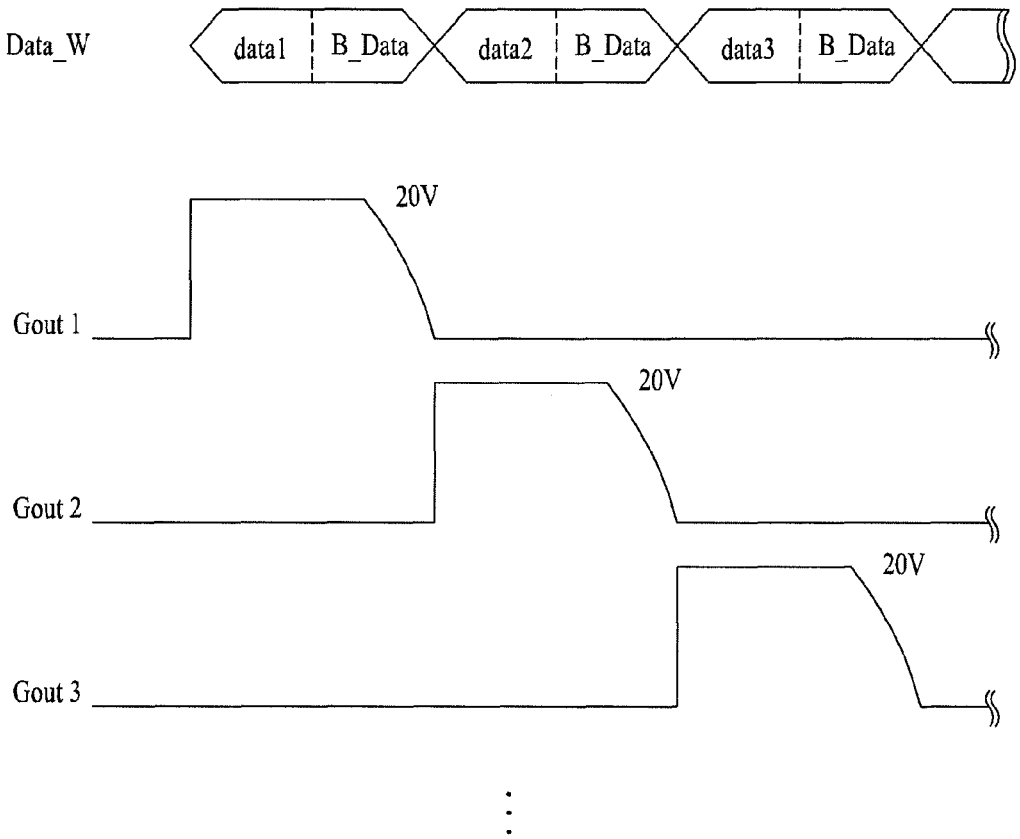
FIG. 4 illustrates a driving method of a liquid crystal display device when a moving image is implemented.

FIG. 4 illustrates a driving method of a liquid crystal display device when a moving image is implemented.

The driving method during implementation of a moving image will now be described with reference to FIG. 4.

If the mode conversion signal MOS indicating the moving image characteristic is supplied from the mode conversion signal generator 16 to the frequency modulator 18, the timing controller 8, and the driving voltage setting unit 9, the frequency modulator 18 increases a driving frequency of each of the externally input synchronous signals DCLK, Vsync, Hsync, and DE to two times and supplies the frequency-increased synchronous signals DCLK', Vsync', Hsync', and DE' to the timing controller 8.

The timing controller 8 doubles the frequency of the data control signal DCS using at least one signal among the frequency-increased synchronous signals DCLK', Vsync', Hsync', and DE' and supplies the frequency-increased data control signal DCS to the data driver 4. Moreover, the timing controller 8 generates the image data Data_B including black data B_Data so as to display an image signal during a ½ period of one horizontal period and to display a black image during the other ½ period and supplies the image data Data_B to the data driver 4.

The data driver 4 latches the image data Data_B including the black data B_Data using the frequency-increased data control signal DCS and supplies an image signal corresponding to one horizontal line to the data lines DL1 to DLm so as to display the black image every ½ period of one horizontal period.

The gate driver 6 sequentially supplies gate-on voltages Gout1 to Gout3 to the gate lines GL1 to GLn in response to the gate control signal GCS, a frequency of which is not modulated, so as to be synchronized with periods during which the image signal corresponding to one horizontal line from the data driver 6 is supplied to the data lines DL1 to DLm. At this time, the gate-on voltages Gout1 to Gout3 supplied to the gate lines GL1 to GLn correspond to the gate high voltage VGH, a supply characteristic of which is not changed.

Figure 5:
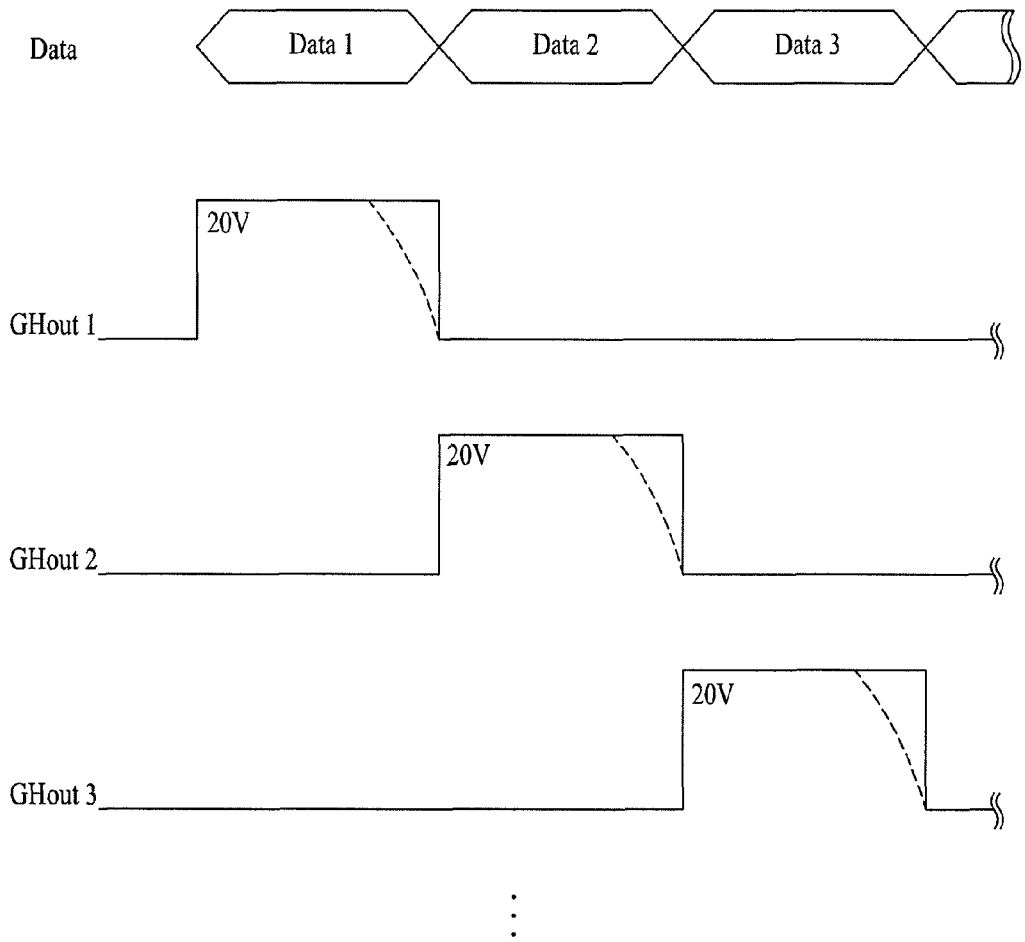
FIG. 5 illustrates a driving method for a liquid crystal display device when a still image is implemented.

FIG. 5 illustrates a driving method for a liquid crystal display device when a still image is implemented.

The driving method during implementation of a still image will now be described with reference to FIG. 5.

If the mode conversion signal MOS indicating the still image characteristic is supplied from the mode conversion signal generator 16 to the timing controller 8 and the driving voltage setting unit 9, the timing controller 8 arranges the image data RGB using the synchronous signals DCLK, Vsync, Hsync, and DE to be suitable for driving the liquid crystal panel 2. The timing controller 8 generates the gate and data control signals GCS and DCS using the synchronous signals DCLK, Vsync, Hsync, and DE and supplies the gate and data control signals GCS and DCS to the gate and data drivers 6 and 4, respectively.

The gate voltage converter 24 included in the driving voltage setting unit 9 supplies the gate high voltage VGH converting a supply characteristic, that is, a charge level to the gate driver 6 in response to the mode conversion signal MOS indicating the still image characteristic. The gate driver 6 generates gate-on voltages GHout1 to GHout3 of the characteristic-converted gate high signal VGH_H and sequentially supplies the gate-on voltages GHout1 to GHout3 to the gate lines GL1 to GLn. The gate-on voltages indicated by dotted lines in FIG. 5 show the gate-on voltages Gout1 to Gout3 during a moving image mode.

As described above, if a currently displayed image is determined as a moving image according to the setting information Oset from a user or a result of analyzing the image data RGB, the driving apparatus and method for the liquid crystal display device of the present invention perform a black data addressing method for displaying a black image every ½ period of one horizontal period by time-division driving respective sub-pixels. If the currently displayed image is a still image, the black data address method is not performed and a gate pulse modulation method for sequentially supplying the gate-on voltages, levels of which are boosted, to the gate lines GL1 to GLn.

The black data addressing and gate pulse modulation methods according to the still image or moving image characteristic may be set such that the data addressing method is performed for the still image and the gate pulse modulation method is performed for the moving image.

The driving apparatus and method for the liquid crystal display device according to the embodiment of the present invention analyze input image data and can change a driving mode for displaying images according to the characteristic of analyzed image data. Therefore, a driving method suitable for the characteristic of an image can be applied and thus picture quality of a displayed image can be improved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving a liquid crystal display device, comprising:

a liquid crystal panel including a plurality of pixel regions to display images; and a liquid crystal panel driving controller for performing either a black data addressing method for time-division driving the liquid crystal panel or a gate pulse modulation method for converting a level of a gate-on voltage supplied to the liquid crystal panel, according to setting information from a user or a moving image or still image characteristic of a currently displayed image, wherein the liquid crystal panel driving controller includes a setting unit for generating a mode conversion signal corresponding to the moving image or still image characteristic by analyzing the setting information or externally input image data, wherein the setting unit includes a data comparator for comparing the image data of the previous frame with image data of a current frame and generating synchronous detection signals according to a comparison result, and a mode conversion signal generator for generating the mode conversion signal according to the setting information, or counting the synchronous detection signals, generates the mode conversion signal indicating the moving image characteristic or still image characteristic depending on whether the number of counts in units of a frame is above or below a number set by a user during a frame set by a user.

2. The apparatus according to claim 1, wherein the liquid crystal panel driving controller more includes:

a data driver for driving data lines of the liquid crystal panel;

a gate driver for driving gate lines of the liquid crystal panel;

a timing controller for supplying the image data, or conversion image data including black data to the data driver in response to the mode conversion signal and generating a data control signal for enabling time-division driving according to the mode conversion signal to control the data driver; and a driving voltage setting unit for converting a supply characteristic of at least one voltage among a plurality of gate driving voltages supplied to the gate driver in response to the mode conversion signal.

3. The apparatus according to claim 2, wherein the setting unit more includes:

a memory for storing image data of a previous frame; and a frequency modulator for converting frequencies of externally input synchronous signals according to the mode conversion signal and supplying the frequency-converted signals to the timing controller.

4. The apparatus according to claim 3, wherein the driving voltage setting unit includes:

a driving voltage generator for generating a common voltage, a gate high voltage, and a gate low voltage using an externally input positive-polarity voltage and negative-polarity voltage; and a gate voltage converter for supplying the gate high voltage to the gate driver in response to the mode conversion signal of the moving image characteristic and boosting a level of the gate high voltage in response to the mode conversion signal of the still image characteristic to supply the boosted voltage to the gate driver.

5. A method for driving a liquid crystal display device, comprising:

determining whether a currently displayed image is a moving image or a still image according to setting information preset by a user;

analyzing whether a currently displayed image is a moving image or a still image by analyzing externally input image data;

generating a mode conversion signal corresponding to a moving image or still image characteristic according to the setting information or the analyzed result; and performing either a black data addressing method for time-division driving a liquid crystal panel or a gate pulse modulation method for converting a supply characteristic of a gate-on voltage supplied to the liquid crystal panel, according to the mode conversion signal, wherein the generating of the mode conversion signal includes storing image data of a previous frame, comparing the image data of the previous frame with image data of a current frame and generating synchronous detection signals according to the comparison result, counting the synchronous detection signals, and generating the mode conversion signals indicating the moving image or still image characteristic according to whether the number of counts in units of a frame is above or below a number set by a user during a frame period set by a user.

6. The method according to claim 5, wherein the performing of either the black data addressing method or the gate pulse modulation method includes:

generating the image data, or conversion image data including black data in response to the mode conversion signal and supplying the generated data to a data driver;

generating a data control signal for enabling time-division driving according to the mode conversion signal to control the data driver;

converting a level of at least one voltage among a plurality of gate driving voltages supplied to a gate driver in response to the mode conversion signal; and converting a frequency of an externally input synchronous signal according to the mode conversion signal and supplying the frequency-converted signal to a timing controller.

7. The method according to claim 6, wherein the converting of the level of at least one voltage includes:

generating a gate high voltage and a gate low voltage using an externally input positive-polarity and negative-polarity voltages;

supplying the gate high voltage to the gate driver in response to the mode conversion signal indicating the moving image characteristic; and supplying the gate high voltage, a charge characteristic of which is not deteriorated, to the gate driver in response to the mode conversion signal indicating the still image characteristic.

* * * * *